US008151421B2

(12) United States Patent
Hsu et al.

(10) Patent No.: US 8,151,421 B2
(45) Date of Patent: Apr. 10, 2012

(54) FOLDABLE PAPER COFFIN

(76) Inventors: Liang Le Hsu, Taichung (TW); Kun Zhang Lin, Taichung (TW)

( * ) Notice: Subject to any disclaimer, the term of this patent is extended or adjusted under 35 U.S.C. 154(b) by 18 days.

(21) Appl. No.: 12/806,575

(22) Filed: Aug. 17, 2010

(65) Prior Publication Data

US 2012/0042488 A1 Feb. 23, 2012

(51) Int. Cl.
*A61G 17/00* (2006.01)

(52) U.S. Cl. ..... 27/4; 27/17; 229/125.38; 229/166; 229/198.1

(58) Field of Classification Search ..... 27/4, 14, 27/17, 19, DIG. 1; 220/6–7, 324; 229/125.01, 229/125.37, 125.38, 165–166, 174–175, 229/181, 185.1, 198.1, 198.3, 199
See application file for complete search history.

(56) References Cited

U.S. PATENT DOCUMENTS 528,612 A 11/1894 Shaw
3,782,619 A * 1/1974 Dittbenner ..... 206/527
4,123,831 A * 11/1978 Covington ..... 27/2
5,307,545 A * 5/1994 Stoltz ..... 27/4
5,586,679 A * 12/1996 Thomas ..... 27/4
6,145,175 A * 11/2000 Enneking et al. ..... 27/4
6,149,845 A 11/2000 Ren
D441,168 S 4/2001 Ling
6,317,943 B1 * 11/2001 Wood ..... 27/4
7,213,312 B2 * 5/2007 Foroni ..... 27/4
2007/0084028 A1 * 4/2007 Cox et al. ..... 27/4

* cited by examiner

*Primary Examiner* — William L. Miller
(74) *Attorney, Agent, or Firm* — Charles E. Baxley

(57) ABSTRACT

A foldable paper coffin includes a casket having a chamber formed by two side walls and two end walls and a bottom wall, and formed with a planar paper sheet having two side panels foldable relative to a bottom panel, two inner panels foldable relative to the side panels, two end panels foldable relative to the bottom panel, two inner folds foldable relative to the end panels, and the end panels and the inner folds each have two foldable end flaps engageable between the inner panels and the side panels, and the side panels and the inner panels and the end flaps each include one or more orifices for engaging with latches and for retaining the casket in a spatial or three-dimensional structure.

8 Claims, 10 Drawing Sheets

FOLDABLE PAPER COFFIN

BACKGROUND OF THE INVENTION

1. Field of the Invention

The present invention relates to a foldable paper coffin, and more particularly to a foldable paper coffin including a foldable structure for allowing the paper coffin to be folded to a compact folding or storing configuration and for allowing the paper coffin to be suitably stored for transportation purposes, and including a weight reduced structure for allowing the paper coffin to be moved by the users.

2. Description of the Prior Art

Typical paper coffins or pulp burial caskets comprise a casket made of fibrous pulp, in which the fibers are compressed together undisturbed in the interlocking relations naturally assumed, in a layer having outer surfaces of relatively greatest density and desiccation and a corresponding texture thence inwardly, and being thereby approximately free from a tendency to warp.

For example, U.S. Pat. No. 528,612 to Shaw discloses one of the typical pulp burial caskets comprising a burial casket made from fibrous pulp materials, that requires no further or final treatments.

However, the pulp burial caskets comprise an integral one-piece structure including a large volume that may not be folded to a compact folding or storing configuration and that may not be suitably stored for transportation purposes.

U.S. Pat. No. 6,149,845 to Ren discloses another typical paper coffin manufacturing method for forming a box and a cover of a coffin from prepared pulp by vacuum molding, drying, and compressing walls of the box and the cover in a die casting machine to an enhanced structural strength.

However, similarly, the box comprises an integral one-piece structure including a large volume that may not be folded to a compact folding or storing configuration and that may not be suitably stored for transportation purposes.

U.S. Design Pat. No. US D441,169S to Ling discloses a further typical paper coffin comprising a burial casket, and a cover pivotally or rotatably coupled to the burial casket for forming a spatial or three-dimensional structure.

However, similarly, the burial casket comprises an integral one-piece structure including a large volume that may not be folded to a compact folding or storing configuration and that may not be suitably stored for transportation purposes.

The present invention has arisen to mitigate and/or obviate the afore-described disadvantages of the conventional foldable paper coffins.

SUMMARY OF THE INVENTION

The primary objective of the present invention is to provide a foldable paper coffin including a foldable structure for allowing the paper coffin to be folded to a compact folding or storing configuration and for allowing the paper coffin to be suitably stored for transportation purposes.

The other objective of the present invention is to provide a foldable paper coffin including a weight reduced structure for allowing the paper coffin to be moved by the users.

In accordance with one aspect of the invention, there is provided a foldable paper coffin comprising a casket including a chamber formed therein and defined by two side walls and two end walls and a bottom wall, and including an upper opening formed therein, the casket being formed with a planar paper sheet having a bottom panel for forming the bottom wall of the casket, two side panels foldable relative to the bottom panel, two inner panels foldable relative to the side panels and engageable into the chamber of the casket and arranged parallel to the side panels, and two end panels foldable relative to the bottom panel, two inner folds foldable relative to the end panels and engageable into the chamber of the casket and arranged parallel to the end panels, and the end panels and the inner folds each including two end flaps foldable relative to the end panels and the inner folds respectively and engageable between the inner panels and the side panels, and the side panels and the inner panels and the end flaps each including at least one orifice formed therein and aligned with each other, at least one latch engaged with the orifice of the side panels and the inner panels and the end flaps for anchoring and retaining the side panels and the inner panels and the end flaps and the end panels and the inner folds together to form the casket and to anchor or retain the casket in a spatial or three-dimensional structure, an inner lining engaged into the chamber of the casket, and a cover attached onto the casket for enclosing the chamber of the casket.

The planar paper sheet includes two flanges foldable relative to the inner panels and engageable with the bottom panel and the bottom wall of the casket for reinforcing the casket. The inner lining includes at least one opening formed therein and aligned with the orifice of the side panels and the inner panels and the end flaps and the latch for preventing the inner lining from being folded or wrinkled.

The casket includes at least one insert engaged between the end panels and the inner folds for further reinforcing the casket. The cover includes at least one loop for engaging with the latch and for stably or solidly anchoring or positioning or retaining the cover to the upper portion of the casket. The casket includes a base plate engaged into the chamber of the casket and engaged with the bottom wall.

The planar paper sheet for the casket and the cover each include at least one primary layer covered with a covering layer for forming a reinforced structure or configuration. The casket includes at least one decorative member engaged with the latch for decorative purposes.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
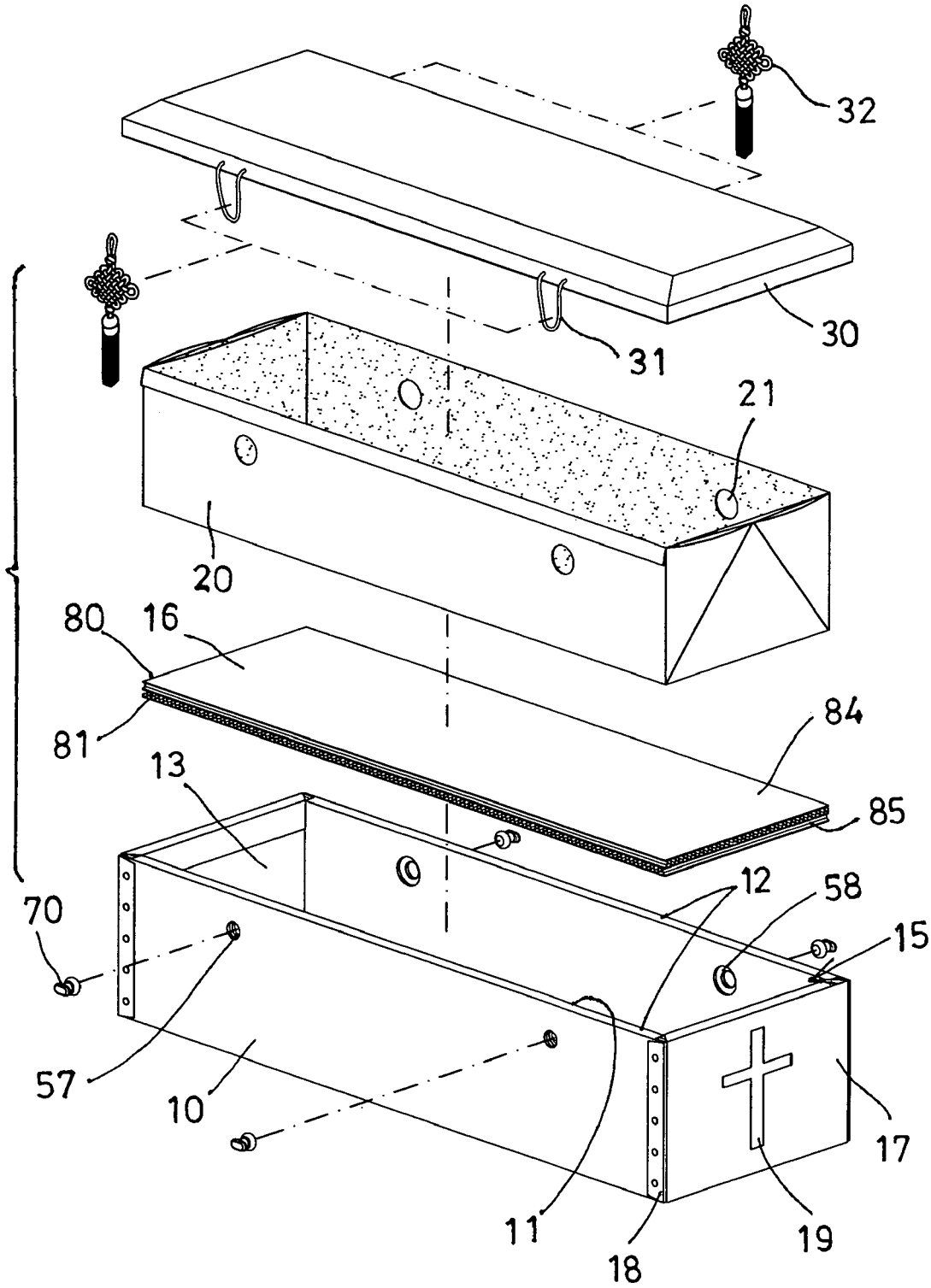
FIG. 1 is a partial exploded view of a foldable paper coffin in accordance with the present invention.
Figure 2:
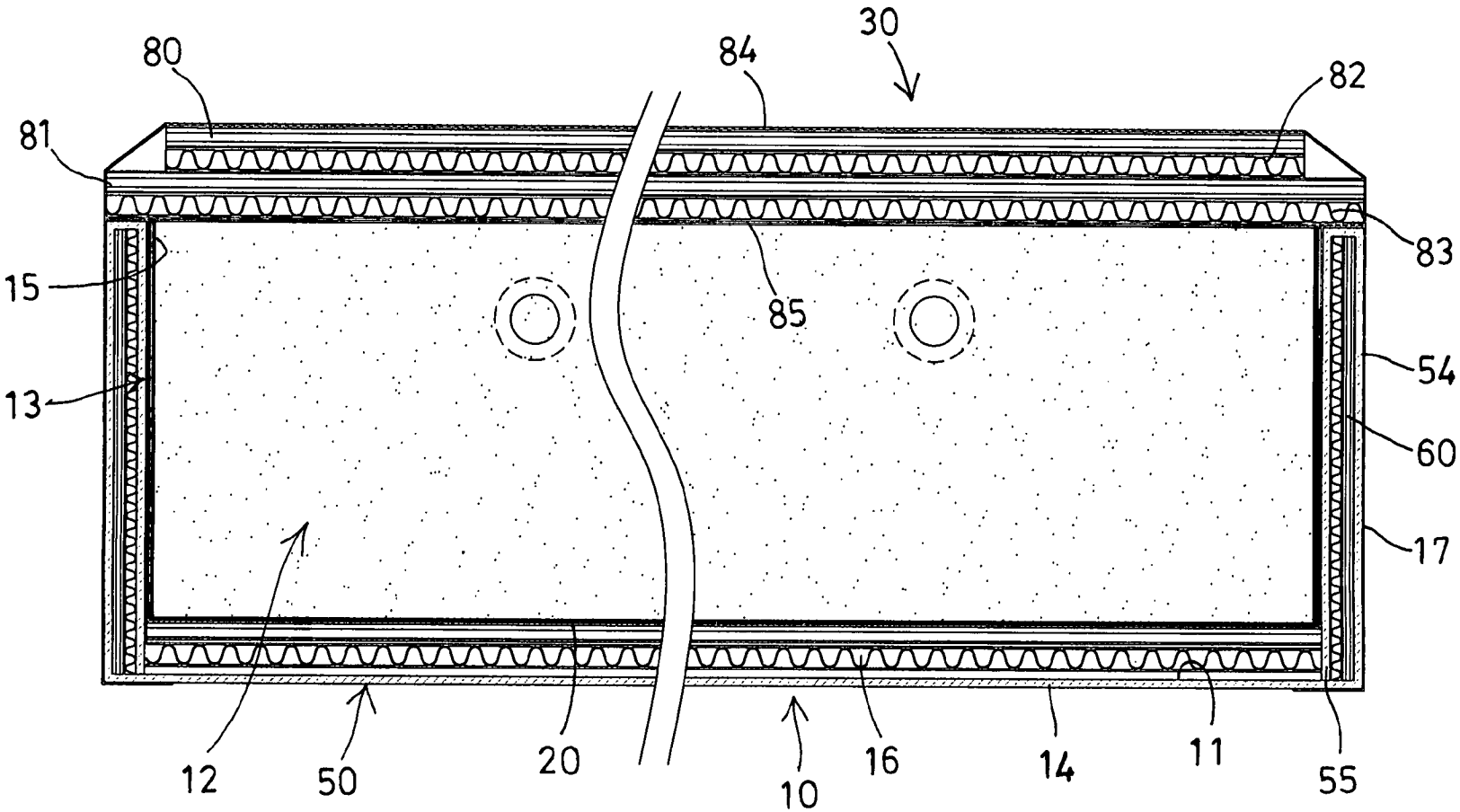
FIG. 2 is a longitudinal cross sectional view of the foldable paper coffin.
Figure 3:
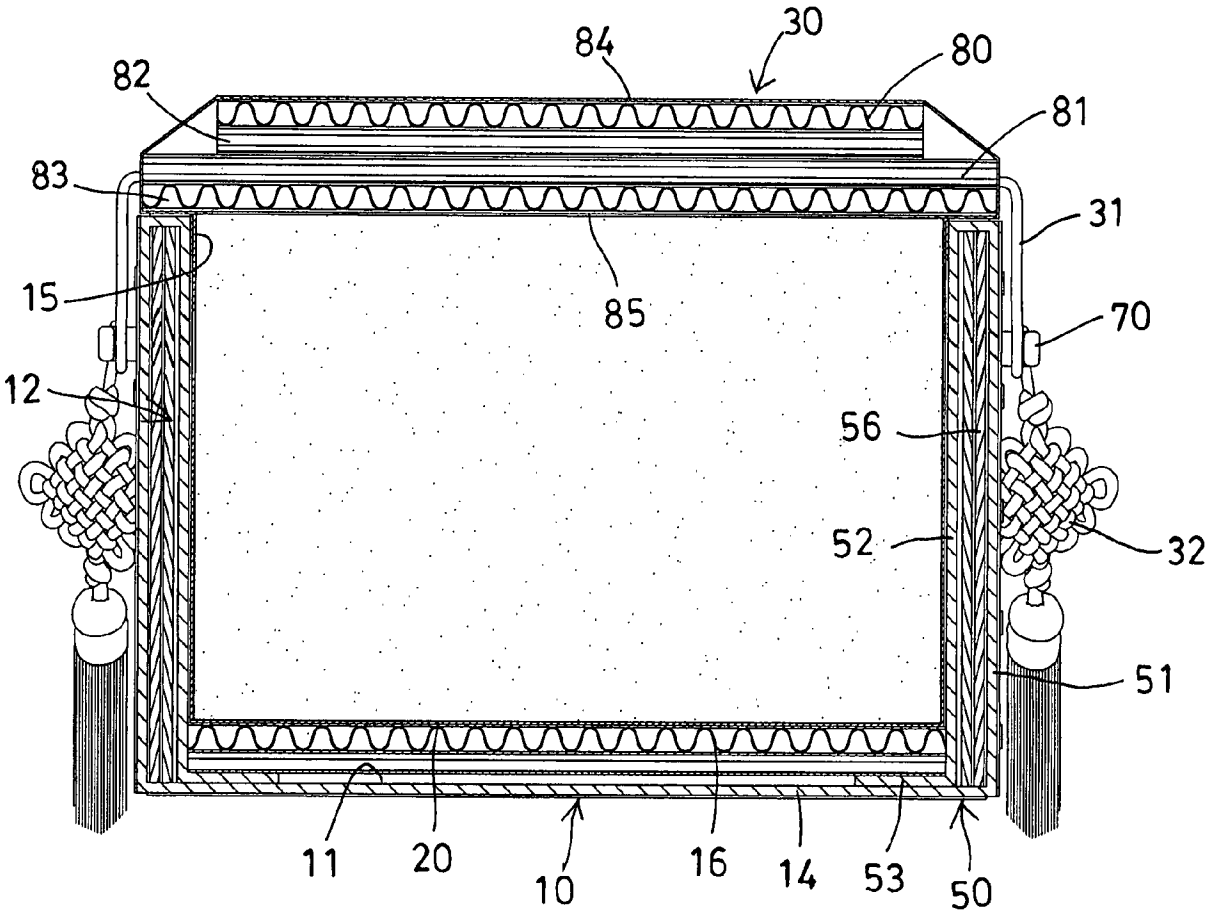
FIG. 3 is a lateral cross sectional view of the foldable paper coffin.
Figure 4:
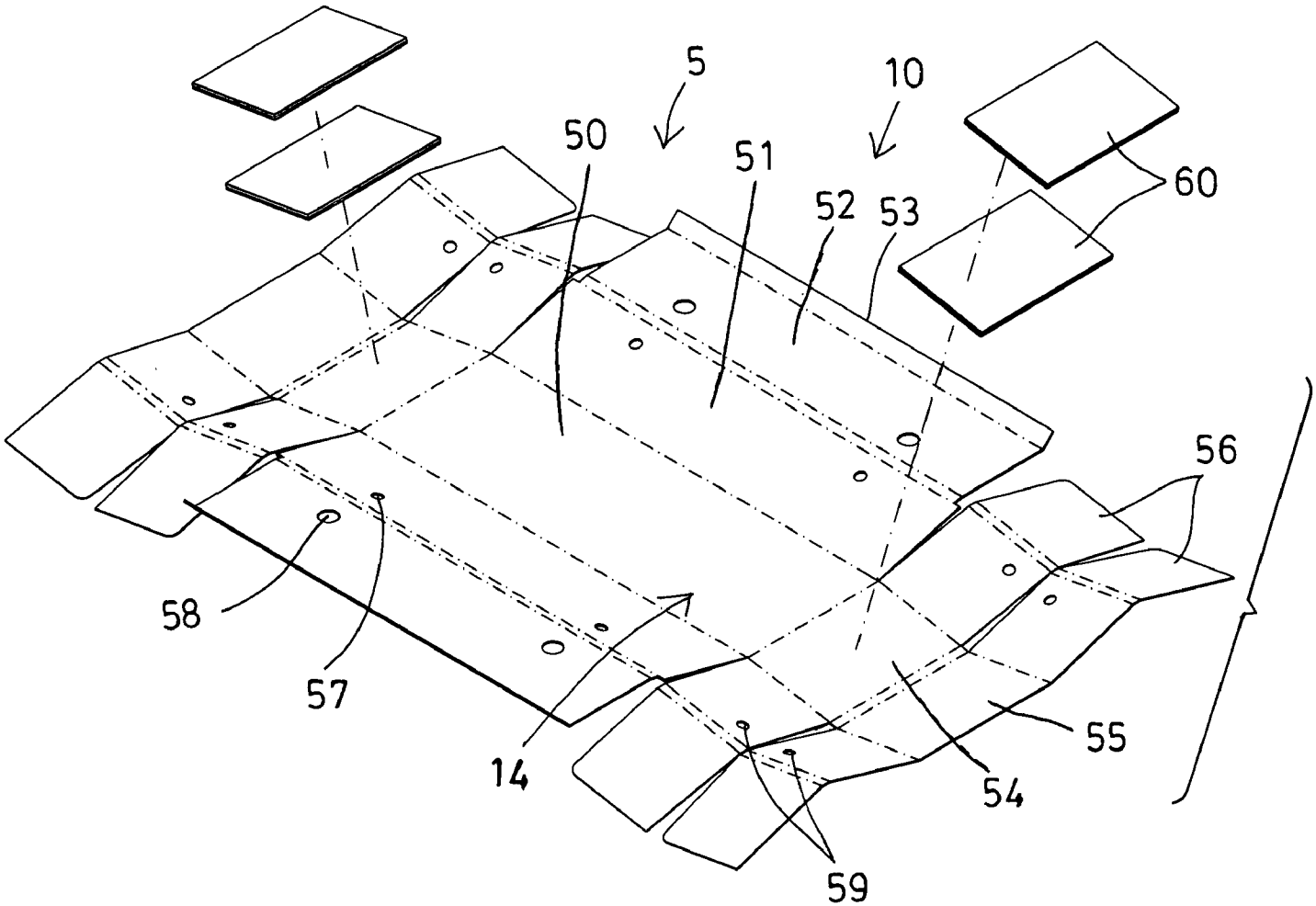
FIG. 4 is another partial exploded view of the foldable paper coffin.
Figure 5:
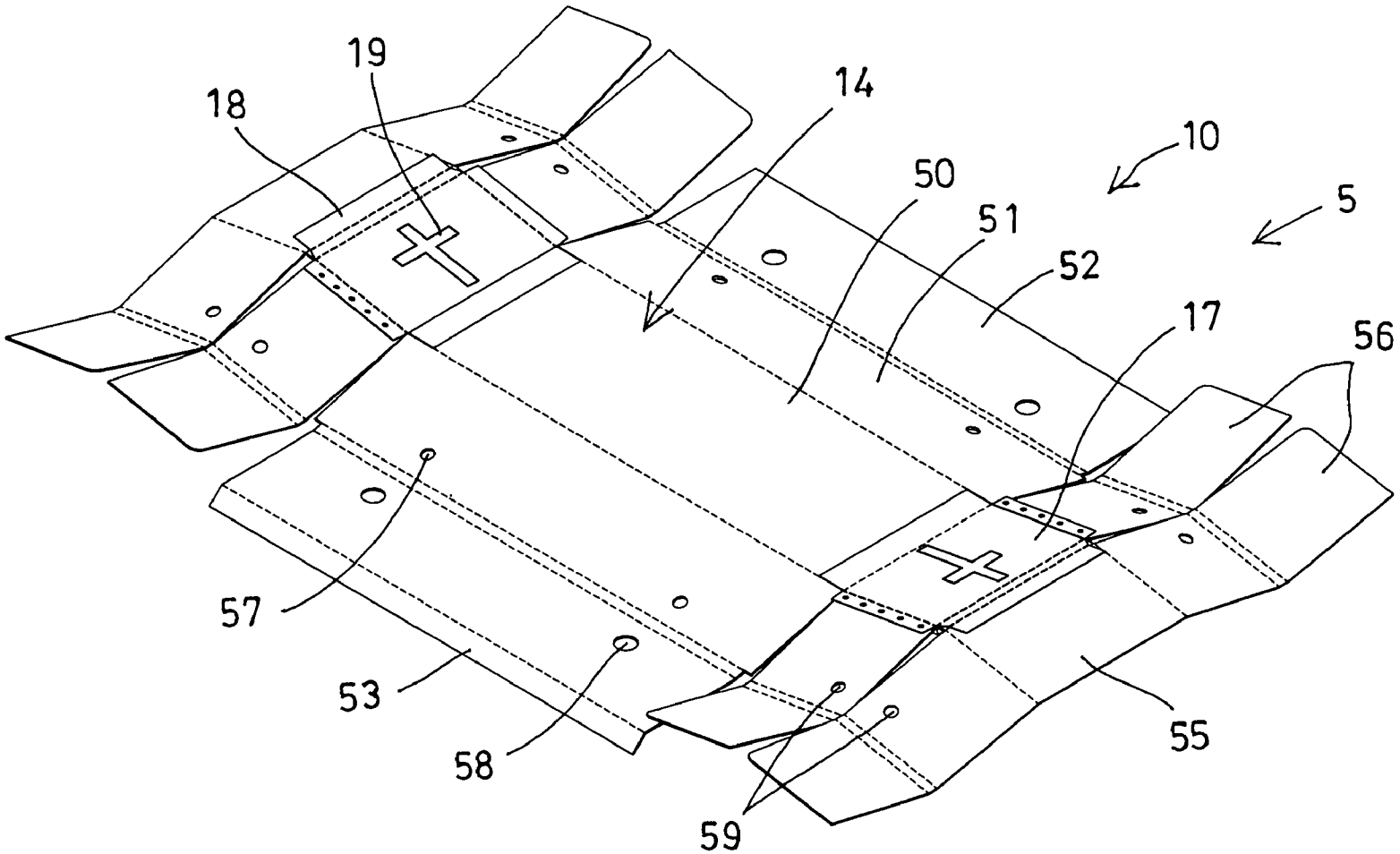
FIG. 5 is a bottom perspective view illustrating the paper sheet for manufacturing the foldable paper coffin.
Figure 6:
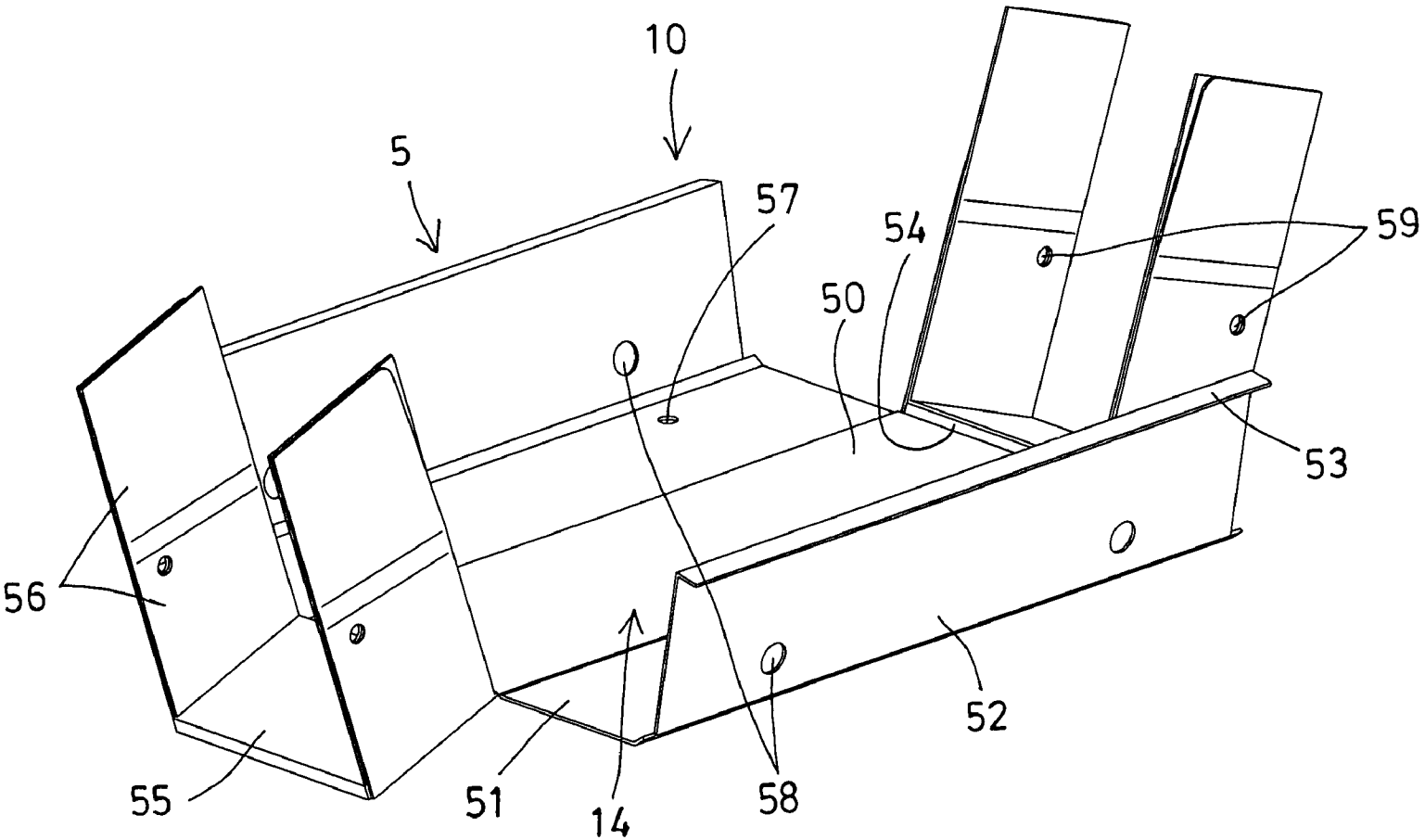
FIGS. 6, 7, 8 are perspective views illustrating the folding operation of the foldable paper coffin.
Figure 7:
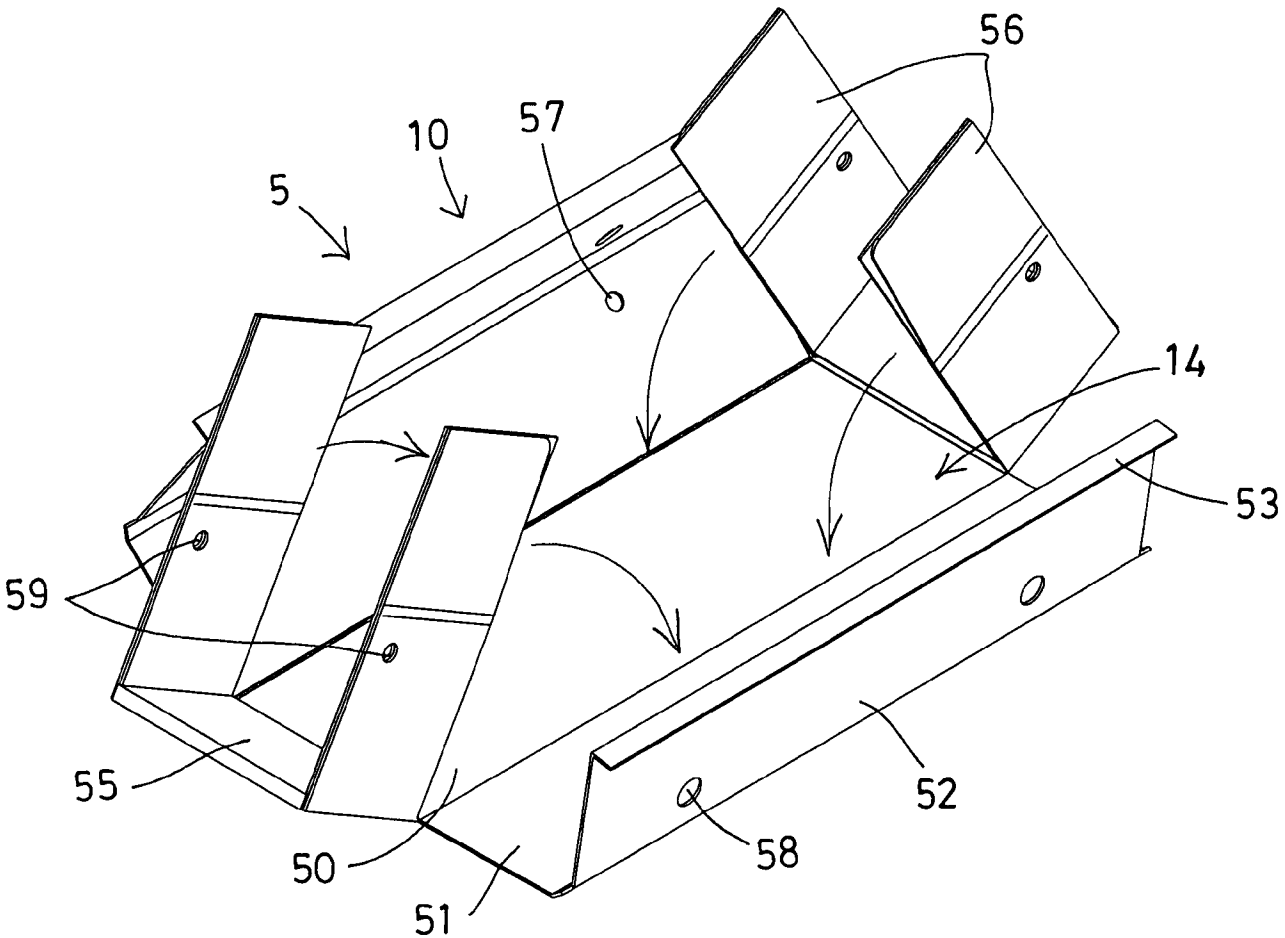
Figure 8:
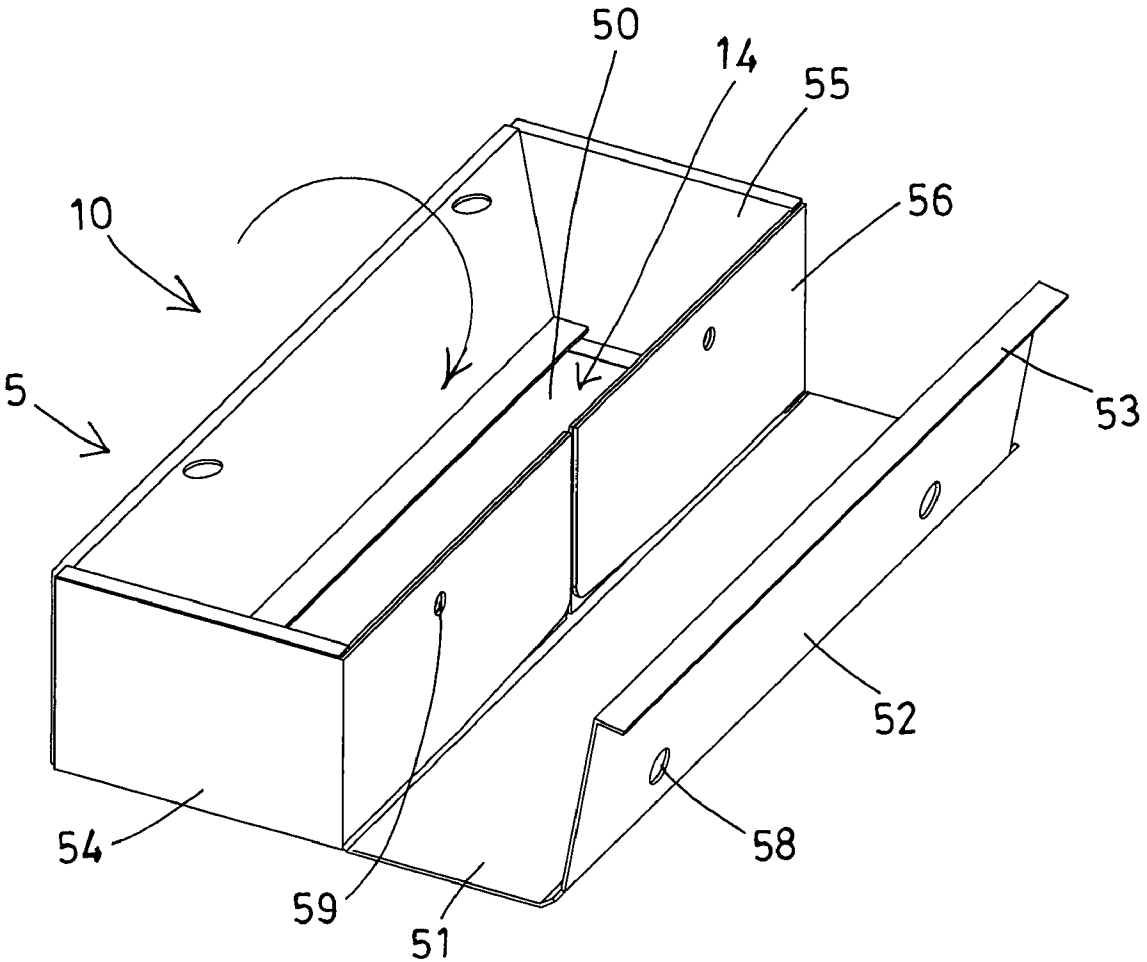

Referring to the drawings, and initially to FIGS. 1-3 and 9, a foldable paper coffin in accordance with the present invention comprises a coffin body or housing or burial casket 10 including a chamber 11 formed therein and defined by two side walls 12 and two end walls 13 and a bottom wall 14, and including an upper opening 15 formed therein, a base plate 16 is engageable through the upper opening 15 and into the chamber 11 of the casket 10 and engaged with the bottom wall 14 for reinforcing the casket 10, two end sheets 17 may further be provided and engaged onto or with the end walls 13 and each include one or more outer peripheral flanges 18 foldable and engageable with the casket 10 for solidly attaching or mounting or securing to the casket 10, and each include one or more decorative words or patterns 19 (FIGS. 1, 5, 9) or the like attached or applied thereon.

Figure 10:
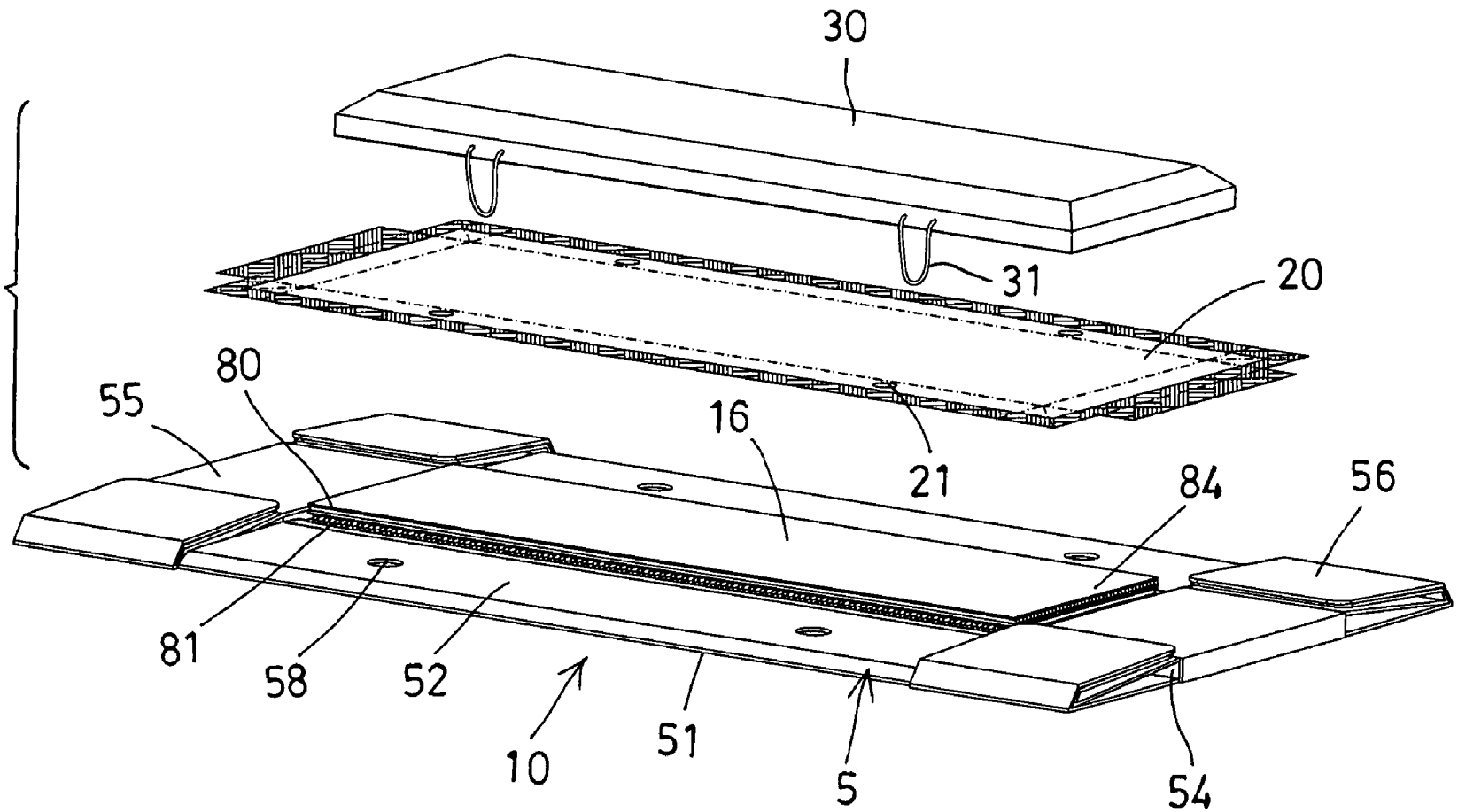
FIG. 10 is a still further partial exploded view illustrating the folding and storing structure of the foldable paper coffin.

An inner lining 20 which is made of cloth or other fibrous materials is engaged into the chamber 11 of the casket 10 and engaged with the base plate 16 and the side walls 12 and the end walls 13 for wrapping or decorating the inner portion of the casket 10. A cover 30 is attached onto the upper portion of the casket 10 for enclosing or blocking the upper opening 15 and the chamber 11 of the casket 10. As shown in FIG. 10, the casket 10 may be folded to a compact folding or storing configuration and the inner lining 20 and the cover 30 also includes a planar configuration for allowing the casket 10 and the inner lining 20 and the cover 30 to be suitably folded and stored in a compact structure and for allowing the paper coffin to be suitably stored for transportation purposes.

As shown in FIGS. 4-8, the casket 10 may be folded or made from a planar paper sheet 5 which include a bottom panel 50 for forming or defining the bottom wall 14 of the casket 10, two side panels 51 foldable relative to the bottom panel 50 to an upwardly erected position, two inner panels 52 foldable relative to the side panels 51 and engageable into the chamber 11 of the casket 10 and arranged parallel to the side panels 51, and two flanges 53 foldable relative to the inner panels 52 and engageable with the bottom panel 50 or the bottom wall 14 of the casket 10, two end panels 54 foldable relative to the bottom panel 50 to an upwardly erected position, two inner folds 55 foldable relative to the end panels 54 and engageable into the chamber 11 of the casket 10 and arranged parallel to the end panels 54.

The end panels 54 and the inner folds 55 each include two end flaps 56 foldable relative to the end panels 54 and the inner folds 55 respectively and engageable between the inner panels 52 and the side panels 51 for further reinforcing the casket 10, and one or more inserts 60 may further be provided and engaged between the end panels 54 and the inner folds 55 for further reinforcing the casket 10. The side panels 51 and the inner panels 52 and the end flaps 56 each include one or more orifices 57, 58, 59 formed therein and aligned with each other for engaging with the buckles or fasteners or locks or latches 70 which may stably or solidly anchor or position or retain the side panels 51 and the inner panels 52 and the end flaps 56 and the end panels 54 and the inner folds 55 together to form the casket 10.

The inner lining 20 may also include one or more openings 21 formed therein and aligned with the orifices 57-59 or the latches 70 for preventing the inner lining 20 from being folded or wrinkled. The cover 30 includes one or more rings or loops 31 for engaging with the latches 70 and for stably or solidly anchoring or positioning or retaining the cover 30 to the upper portion of the casket 10. One or more decorative knots or members 32 may further be provided and engaged and attached or mounted or secured onto the latches 70 (FIG. 3) for decorative purposes. As shown in FIGS. 1-3, and 10, the base plate 16 and/or the cover 30 and/or the casket 10 and/or the paper sheet 5 may be made of moisture-barrier, thermoplastic, polypropylene (PP), laminated, corrugated paperboards each having one or more primary layers 80, 81, 82, 83 covered with one or more covering layers 84, 85 for forming a structure or configuration having a greatly increased bending strength.

Figure 9:
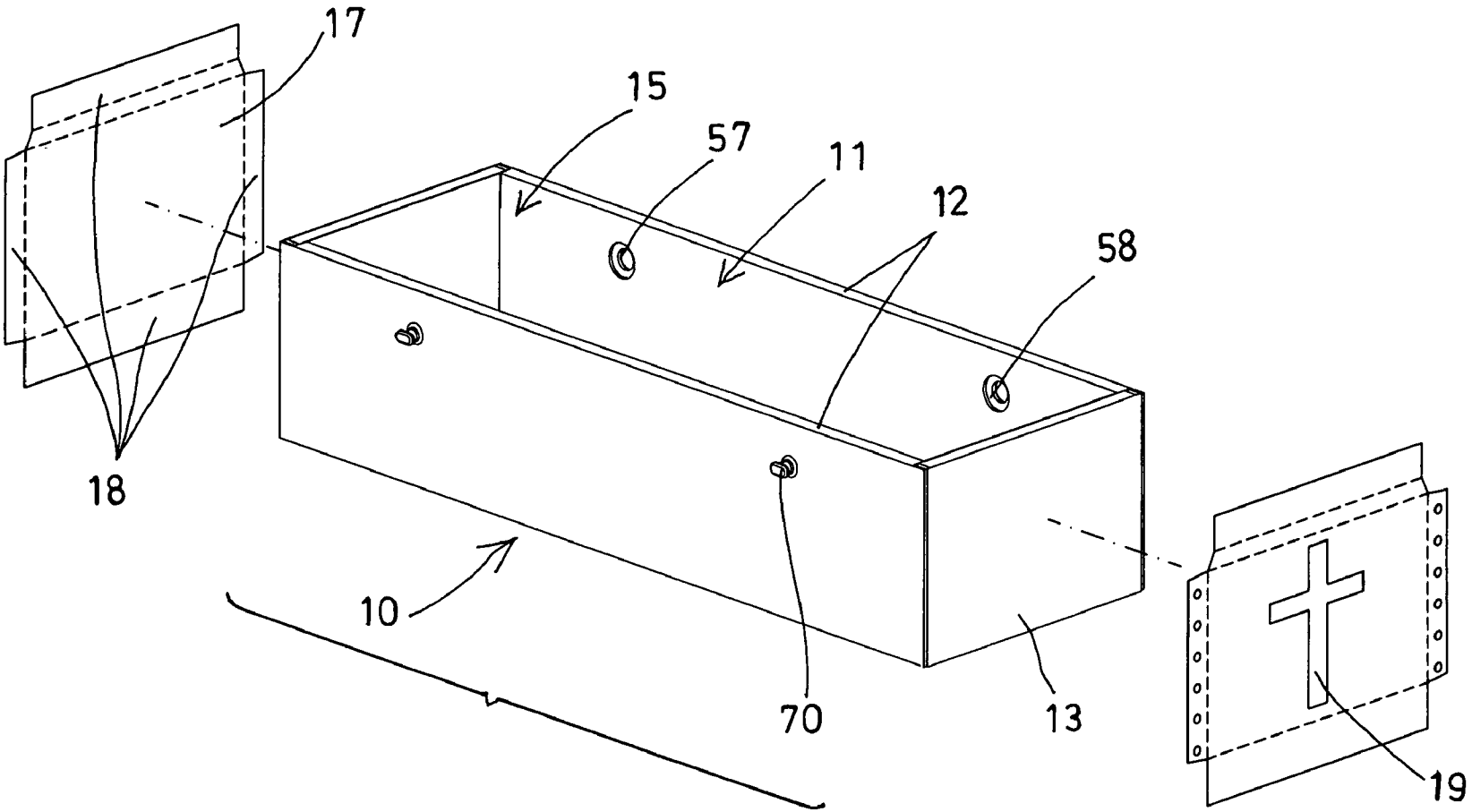
FIG. 9 is a further partial exploded view illustrating the manufacturing operation of the foldable paper coffin.

In operation, as shown in FIGS. 4-8, the planar paper sheet 5 may first be folded to form the spatial or three-dimensional casket 10 as shown in FIG. 9, and the end sheets 17 may then be engaged onto or with the end walls 13 (FIG. 9), or attached onto the end walls 13 (FIG. 5) before folding, the base plate 16 may then be engaged through the upper opening 15 and into the chamber 11 of the casket 10 and engaged with the bottom wall 14, and the inner lining 20 may then be engaged into the chamber 11 of the casket 10 and engaged with the base plate 16 and the side walls 12 and the end walls 13, and the cover 30 may then be attached onto the upper portion of the casket 10 for enclosing or blocking the upper opening 15 and the chamber 11 of the casket 10.

It is to be noted that the casket 10 may be folded to a compact folding or storing configuration and for allowing the paper coffin to be suitably stored for transportation purposes, and the casket 10 includes a greatly weight reduced structure for allowing the paper coffin to be easily moved or carried or transported by the users.

Accordingly, the foldable paper coffin in accordance with the present invention includes a foldable structure for allowing the paper coffin to be folded to a compact folding or storing configuration and for allowing the paper coffin to be suitably stored for transportation purposes, and includes a weight reduced structure for allowing the paper coffin to be moved by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A foldable paper coffin comprising:

a casket including a chamber formed therein and defined by two side walls and two end walls and a bottom wall, and including an upper opening formed therein, said casket being formed with a planar paper sheet having a bottom panel for forming said bottom wall of said casket, two side panels foldable relative to said bottom panel, two inner panels foldable relative to said side panels and engageable into said chamber of said casket and arranged parallel to said side panels, said two side panels and said two inner panels forming said two side walls of said casket, and two end panels foldable relative to said bottom panel, two inner folds foldable relative to said end panels and engageable into said chamber of said casket and arranged parallel to said end panels, said two end panels and said two inner folds forming said two end walls of said casket, and said end panels and said inner folds each including two end flaps foldable relative to said end panels and said inner folds respectively and engageable between said inner panels and said side panels, and said side panels and said inner panels and said end flaps each including at least one orifice formed therein and aligned with each other, at least one latch engaged with said at least one orifice of said side panels and said inner panels and said end flaps for anchoring and retaining said side panels and said inner panels and said end flaps and said end panels and said inner folds together to form said casket, an inner lining engaged into said chamber of said casket, and a cover attached onto said casket for enclosing said chamber of said casket.

2. The foldable paper coffin as claimed in claim 1, wherein said planar paper sheet includes two flanges foldable relative to said inner panels and engageable with said bottom panel and said bottom wall of said casket.

3. The foldable paper coffin as claimed in claim 1, wherein said inner lining includes at least one opening formed therein and aligned with said at least one orifice of said side panels and said inner panels and said end flaps and said at least one latch.

4. The foldable paper coffin as claimed in claim 1, wherein said casket includes at least one insert engaged between said end panels and said inner folds for reinforcing said casket.

5. The foldable paper coffin as claimed in claim 1, wherein said cover includes at least one loop for engaging with said at least one latch.

6. The foldable paper coffin as claimed in claim 1, wherein said casket includes a base plate engaged into said chamber of said casket and engaged with said bottom wall.

7. The foldable paper coffin as claimed in claim 1, wherein said planar paper sheet for said casket and said cover each include at least one primary layer covered with a covering layer.

8. The foldable paper coffin as claimed in claim 1, wherein said casket includes at least one decorative member engaged with said at least one latch.

* * * * *